US006619089B2

(12) United States Patent
Doherty

(10) Patent No.: US 6,619,089 B2
(45) Date of Patent: Sep. 16, 2003

(54) TUBE CORRUGATING APPARATUS AND METHOD

(76) Inventor: John Doherty, 18 Pearl Crest Ct., Pearl River, NY (US) 10965

( * ) Notice: Subject to any disclaimer, the term of this patent is extended or adjusted under 35 U.S.C. 154(b) by 0 days.

(21) Appl. No.: 10/141,285

(22) Filed: May 9, 2002

(65) Prior Publication Data

US 2002/0178773 A1 Dec. 5, 2002

Related U.S. Application Data

(60) Provisional application No. 60/290,532, filed on May 11, 2001.

(51) Int. Cl.[7] ..... B21D 3/00
(52) U.S. Cl. ..... 72/78; 72/112; 72/370.19
(58) Field of Search ..... 72/77, 78, 112, 72/126, 370.19, 370.2, 399

(56) References Cited

U.S. PATENT DOCUMENTS 2,614,607 A 10/1952 Klein
3,387,477 A * 6/1968 Shupper ..... 72/77
3,780,556 A 12/1973 Johnson
4,043,161 A * 8/1977 Toma et al. ..... 72/78
4,339,936 A 7/1982 Pressman
4,435,968 A 3/1984 Roderburg
4,776,195 A * 10/1988 Fukuhara et al. ..... 72/224
6,009,767 A * 1/2000 Rudolph ..... 74/86
6,073,473 A 6/2000 Ziemek
6,164,472 A * 12/2000 Folchini ..... 215/328

* cited by examiner

*Primary Examiner*—Ed Tolan
(74) *Attorney, Agent, or Firm*—Schweitzer Cornman Gross & Bondell LLP

(57) ABSTRACT

A method and apparatus for forming annularly-corrugated tubes and cables utilizing a multiple gear corrugating head which is rotated about the tube or cable, to be corrugated as the tube or cable is drawn through the head. Two or more of the gears each have a different prime number of gear teeth which form the corrugation. A radio-frequency cable formed by the invention exhibit greater consistency and quality than cables produced by conventional corrugating gear heads, and in particular, show improved VSWR characteristics

10 Claims, 12 Drawing Sheets

SIMULATION DATA FOR MIL SPEC 7/8"

| | | | | |
|---|---|---|---|---|
| NUM. OF GEARS | 3 | LENGTH | 11.733 | FT. |
| GEAR 1 | 16 | MAX Z | 51.920 | Ohms |
| SPIKE F - Ghz | 1.1937 | MIN Z | 49.183 | Ohms |
| GEAR 2 | 16 | AVG Z | 50.946 | Ohms |
| SPIKE F - Ghz | 1.1937 | MED Z | 51.141 | Ohms |
| GEAR 3 | 16 | STD DEV Z | 0.739 | Ohms |
| SPIKE F - Ghz | 1.1937 | MAX VSWR | 1.360 | |
| | | MAX FFT | 0.28963 | |
| | | PITCH | 0.275 | INCH |
| | | VP | 89.00% | % |
| | | F SHIFT | 36.1708 | Mhz |

Z - VARIANCE +/- 2.00 Ohms

SIMULATION DATA FOR MIL SPEC 7/8"

| | | | | |
|---|---|---|---|---|
| NUM. OF GEARS | 4 | LENGTH | 11.733 | FT. |
| GEAR 1 | 16 | MAX Z | 51.944 | Ohms |
| SPIKE F - Ghz | 1.1937 | MIN Z | 49.528 | Ohms |
| GEAR 2 | 16 | AVG Z | 51.105 | Ohms |
| SPIKE F - Ghz | 1.1937 | MED Z | 51.258 | Ohms |
| GEAR 3 | 16 | STD DEV Z | 51.256 | Ohms |
| SPIKE F - Ghz | 1.1937 | MAX VSWR | 0.733 | |
| GEAR 4 | 16 | MAX FFT | 0.29631 | |
| SPIKE - F Ghz | 1.1937 | PITCH | 0.275 | INCH |
| | | VP | 89.00% | % |
| | | F SHIFT | 36.1708 | Mhz |

Z - VARIANCE +/- 2.00 Ohms

SIMULATION DATA FOR MIL SPEC 7/8"

| | | | | |
|---|---|---|---|---|
| NUM. OF GEARS | 5 | LENGTH | 11.733 | FT. |
| GEAR 1 | 16 | MAX Z | 51.944 | Ohms |
| SPIKE F - Ghz | 1.1937 | MIN Z | 49.528 | Ohms |
| GEAR 2 | 16 | AVG Z | 51.242 | Ohms |
| SPIKE F - Ghz | 1.1937 | MED Z | 51.655 | Ohms |
| GEAR 3 | 16 | STD DEV Z | 0.714 | Ohms |
| SPIKE F - Ghz | 1.1937 | MAX VSWR | 1.079 | |
| GEAR 4 | 16 | MAX FFT | 0.28066 | |
| SPIKE F - Ghz | 1.1937 | PITCH | 0.275 | INCH |
| GEAR 5 | 16 | VP | 89.00% | % |
| SPIKE F - Ghz | 1.1937 | F SHIFT | 36.1708 | Mhz |

| | | |
|---|---|---|
| SPIKE F - Ghz | 0.8681 | |
| Z - VARIANCE | +/- 2.00 | Ohms |

SIMULATION DATA FOR MIL SPEC 7/8"

| | | | | |
|---|---|---|---|---|
| NUM. OF GEARS | 3 | LENGTH | 11.733 | FT. |
| GEAR 1 | 11 | MAX Z | 51.920 | Ohms |
| SPIKE F - Ghz | 1.7363 | MIN Z | 48.244 | Ohms |
| GEAR 2 | 13 | AVG Z | 51.087 | Ohms |
| SPIKE F - Ghz | 1.4692 | MED Z | 51.258 | Ohms |
| GEAR 3 | 17 | STD DEV Z | 0.699 | Ohms |
| SPIKE F - Ghz | 1.1235 | MAX VSWR | 1.182 | |
| | | MAX FFT | 0.18805 | |
| | | PITCH | 0.275 | INCH |
| | | VP | 89.00% | % |
| | | F SHIFT | 448.656 | Mhz |

SPIKE F - Ghz 0.8681

Z - VARIANCE +/- 2.00 Ohms

SIMULATION DATA FOR MIL SPEC 7/8"

| | | | | |
|---|---|---|---|---|
| NUM. OF GEARS | 4 | LENGTH | 11.733 | FT. |
| GEAR 1 | 11 | MAX Z | 51.944 | Ohms |
| SPIKE F - Ghz | 1.7363 | MIN Z | 48.400 | Ohms |
| GEAR 2 | 13 | AVG Z | 51.267 | Ohms |
| SPIKE F - Ghz | 1.4692 | MED Z | 51.319 | Ohms |
| GEAR 3 | 17 | STD DEV Z | 0.623 | Ohms |
| SPIKE F - Ghz | 1.1235 | MAX VSWR | 1.120 | |
| GEAR 4 | 19 | MAX FFT | 0.13882 | |
| SPIKE F - Ghz | 1.0052 | PITCH | 0.275 | INCH |
| | | VP | 89.00% | % |
| | | F SHIFT | 246.74 | Mhz |

Z - VARIANCE +/- 2.00 Ohms

SIMULATION DATA FOR MIL SPEC 7/8"

| | | | | |
|---|---|---|---|---|
| NUM. OF GEARS | 5 | LENGTH | 11.733 | FT. |
| GEAR 1 | 11 | MAX Z | 51.944 | Ohms |
| SPIKE F - Ghz | 1.7363 | MIN Z | 48.400 | Ohms |
| GEAR 2 | 13 | AVG Z | 51.372 | Ohms |
| SPIKE F - Ghz | 1.4692 | MED Z | 51.623 | Ohms |
| GEAR 3 | 17 | STD DEV Z | 0.574 | Ohms |
| SPIKE F - Ghz | 1.1235 | MAX VSWR | 1.084 | |
| GEAR 4 | 19 | MAX FFT | 0.10605 | |
| SPIKE F - Ghz | 1.0052 | PITCH | 0.275 | INCH |
| GEAR 5 | 23 | VP | 89.00% | % |
| SPIKE F - Ghz | 0.8304 | F SHIFT | 197.391 | Mhz |

Z - VARIANCE +/- 2.00 Ohms

TUBE CORRUGATING APPARATUS AND METHOD

This application claims the priority of Provisional Application Serial No. 60/290,532 filed May 11, 2001.

FIELD OF THE INVENTION

The present invention relates to machinery for corrugating tubes and more particularly to the corrugating head of such machines.

BACKGROUND OF THE INVENTION

The use of corrugated tubes has become ever more prevalent in the field of communication and electrical transmission. Corrugated tubes are efficient devices for transmitting various information and/or electrical currents. Several different methods and apparatuses have been developed for manufacturing such tubes.

The present invention relates to a method and apparatus for corrugating tubes and more particularly for forming corrugations in the continuous production of tubing of the type used in high-frequency cables, wave guides and the like.

A number of methods and types of apparatus have been devised to produce corrugations in metallic (including metal-like) tubes. Corrugation is typically applied when there is a particular need for flexibility. There are two general classes of corrugated tubing, helical and annular. In helical tubing the tube is corrugated in a continuous helix along its length. In annular tubing the corrugation takes the form of individual corrugation annuli. Annular cables are typically used in outdoor applications where water migration is of concern. With helical cables the continuous form of the corrugated helix can permit water which enters through a hole to migrate along the helix through a length of the tube. The independent corrugations or annuli of an annular cable limit such migration.

Smoothness and uniformity of corrugation formation is found particularly critical in the case of tubing for high-frequency radiation transmission, such as coaxial cable and wave guides, where attenuation and compliance with mechanical specifications, such as military specification ML-C-28830C, is necessary. Corrugation imperfections and pitch variations too small to be readily observed have been found to produce highly undesirable reflections or standing waves.

Quality deficiencies can result from mechanical vibration, which may arise from various sources within the equipment. Bearings, sheaves, gearboxes, belts and pulleys can all be sources of such vibrations. The vibrations, while often small in magnitude, are typically periodic and can cause small inconsistencies in the formation of the corrugations, which in turn can create variations in the electrical response of the cable or tubing over the frequency spectrum of interest, and particularly variation in the voltage standing wave ratio (VSWR) of the cable. It is desirable that the VSWR be as low as possible, 1.00 being indicative of no reflection losses, with typical values of 1.05–1.15 being desired. The rotation of the typical corrugation head of a corrugating apparatus having several gears is a prime source for such vibrations, and is a significant area of concern in producing cables and wave guides of low and consistent VSWR.

U.S. Pat. No. 3,780,556 is illustrative of known systems for producing annularly corrugated tubes. A corrugating head has one or more gear-like corrugating wheels, each mounted both for free rotation about an axis transverse to the main, longitudinal axis of the tube to be corrugated and for orbital rotation about the longitudinal axis of the tube. The tube is drawn along the longitudinal axis through the corrugating head, while the corrugating wheels are orbited about the tube. The gear wheel teeth emboss annular corrugations in the tube, the individual gear teeth of the wheels aligning with the portion of the corrugation generated by the other gear wheels as a result of the free-wheeling nature of the gears. The general shape of the gears, as well as their orbital rotation rate and the longitudinal speed of travel of the tube through the head, are determined and applied as known in the art.

Although corrugating machines incorporating the foregoing technology are generally capable of producing annularly corrugated tubing in an efficient manner, due to the high tolerances required, particularly in connection with high the production of high frequency RF cables, it has heretofore been difficult to produce long runs of such cable without defects and/or inconsistencies which affect their performance.

It is accordingly a purpose of the present invention to provide a method and apparatus for tube corrugating, and particularly for a corrugating head of the multiple gear type, which exhibits improved performance and consistency of results.

Yet another purpose of the present invention is to provide a tube corrugating method and apparatus which allows increased lengths of annularly corrugated tube to be generated with greater precision and uniformity than has heretofore been produced.

BRIEF DESCRIPTION OF THE INVENTION

In accordance with the foregoing and other purposes and benefits, the method of the present invention, and a tube corrugating apparatus constructed in accordance with the present invention, incorporate a multiple gear corrugating head in which each gear has a different number of gear teeth. Each gear has the teeth at the same pitch, such that each gear is thus of a different diameter. The number of teeth on each gear is chosen to minimize the constructive reinforcement of harmful vibrations which arise from gear rotation, such that the effects of such vibrations transmitted to the tube passing through the corrugating head and which manifests itself as tube inconsistencies, are minimized. In particular, the use of gears each having a different prime number results in minimization of additive vibration effects. The gear head may preferably be utilized in connection with a hollow shaft motor to further limit and minimize such vibrational effects.

BRIEF DESCRIPTION OF THE DRAWINGS

A fuller understanding of the present invention will be accomplished upon consideration of the following detailed description of a preferred, but nonetheless illustrative embodiment of the invention, when reviewed in connection with the annexed drawings, wherein.

DETAILED DESCRIPTION OF THE INVENTION

Figure 1:
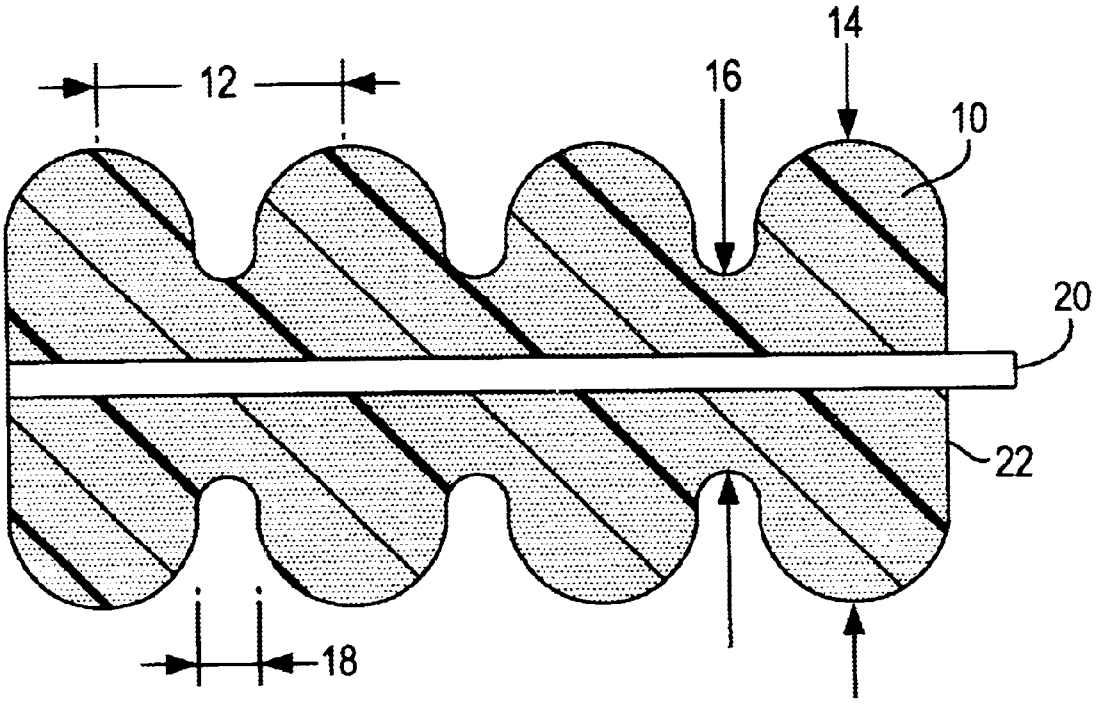
FIG. 1 is a schematic drawing of a radio frequency cable bearing annular corrugations of the type formed by the present invention.

With initial reference to FIG. 1, an RF cable or similarly tubed construction having annular corrugations on its exterior wall surface 10 has corrugations of a constant pitch 12, which is the distance between the corresponding locations on adjacent annuli. Each of the annuli has a major outer diameter 14 and a minor outer diameter 16. Particularly when formed on gear head-type corrugating systems, the tubing wall surrounding the location of the minor outer diameter includes a small arcuate section, the distance between the opposed wall portions defining the root diameter 18. In general, the pitch, major and minor outer diameters and root diameters are chosen in accordance with required mechanical and electrical specifications and the general capabilities of the manufacturing equipment as known in the art. A typical cable further includes a center conductor 20 which may be surrounded by a foam core 22.

Figure 2:
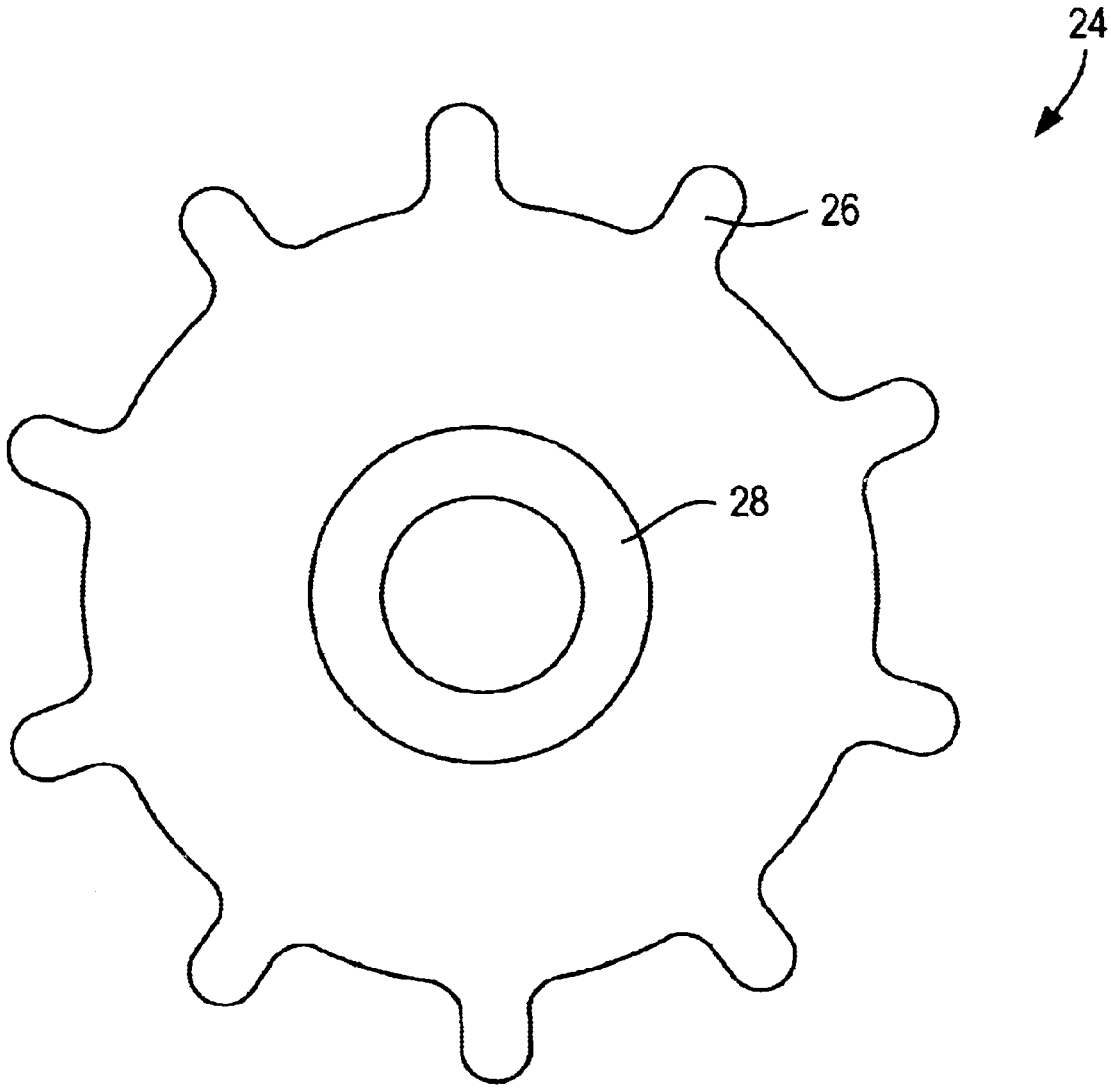
FIG. 2 is an elevation view of a corrugating gear of the present invention.

The present invention utilizes a unique arrangement of gear teeth on the gears of a gear-type corrugating apparatus of known general construction to form annular corrugations in the general manner known in the art, but with a significantly lower level of irregularities and inconsistencies which may have a deleterious effect on tubing performance and particularly on the performance of corrugated high-frequency radio frequency cables. As depicted in FIG. 2, a corrugating gear 24 of the present invention is of generally conventional configuration, with a plurality of gear teeth 26 arranged about the periphery of the gear. The gear is provided with a central bearing 28 for mounting in the corrugating head in a conventional manner. The general geometry is also known in the art as the height and shape of the teeth dictating the major and minor diameters for the cable annuli while the pitch or spacing of the teeth about the periphery of the gear corresponds to the pitch of the annuli to be formed on the cable.

The teeth 26 of each gear incorporated into a gear head constructed in accordance with the present invention is chosen to have a different number of teeth, as the characteristic vibrations associated with the rotating gear is a function of the number of gear teeth. With different numbers of teeth, the vibration frequencies associated with each rotating gear are different, with the peaks and troughs of the oscillations occurring at different times. Thus, the additive and cumulative effect of such vibrations results in a relatively low level of vibration over a wide range of frequencies, rather than high levels of vibrations at fewer frequencies resulting from the cumulative addition of simultaneously occurring peaks and troughs. It is high vibration levels which manifest themselves as irregularities in the formed tubing which affect performance. In particular, and to minimize the construction addition of the vibrations, each of the gears is preferably chosen to have a number of teeth 26 corresponding to a unique prime number.

Figure 3:
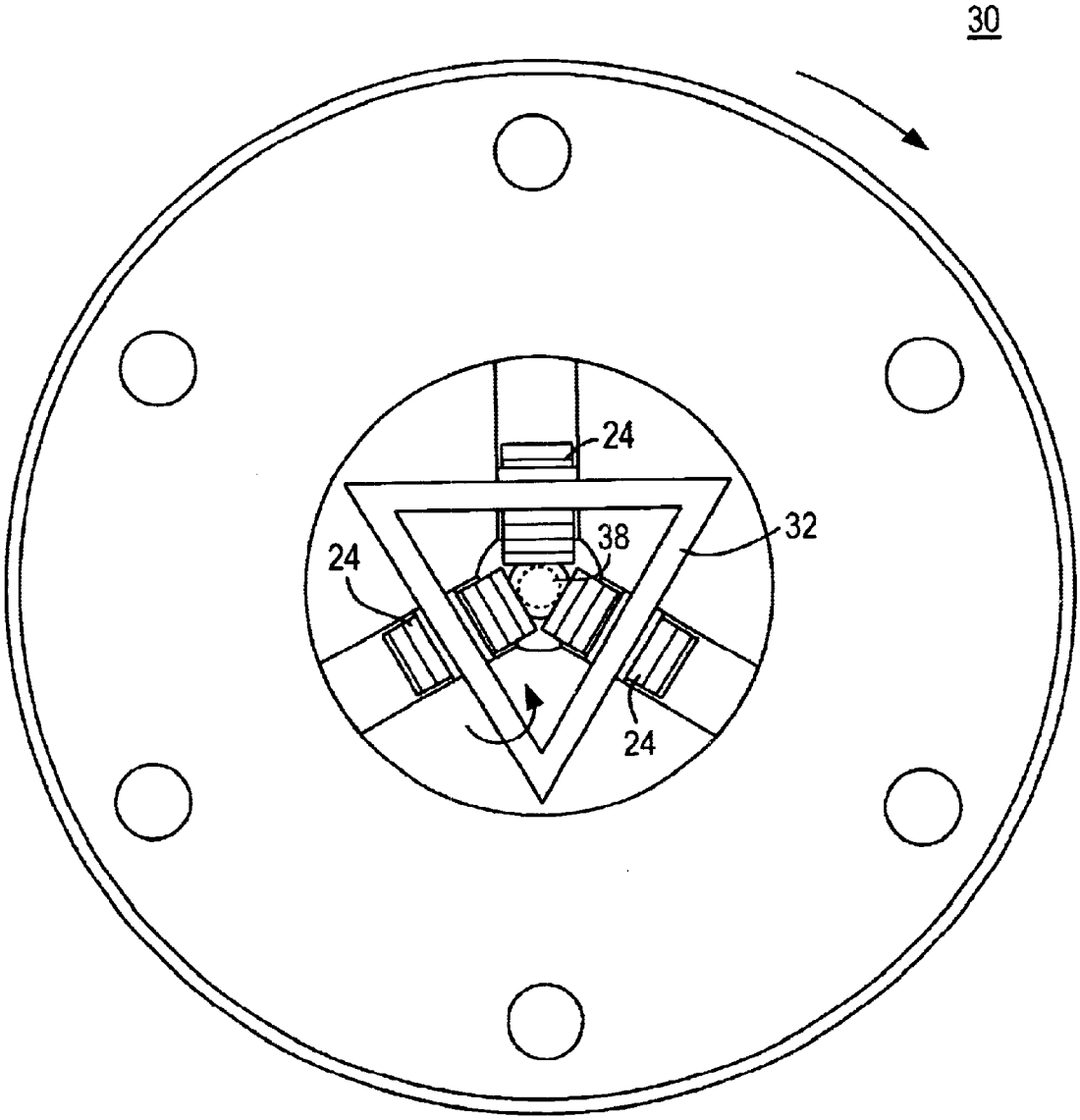
FIG. 3 is an end view of a corrugating head of the type utilized in the present invention.

It has been found that the greater the number of gears incorporated into the gear head, each with a different prime number of teeth, the higher quality of the resulting cable, and in particular the lower the overall VSWR of the cable. Practical physical constraints, however, dictate the number of gears that can be utilized. In general, the number of gears which can be effectively utilized is directly related to the diameter of the tubing or cable to be corrugated. The larger the diameter of tubing, the greater the number of gears that can be oriented thereabout. As shown in FIG. 3, a corrugating head 30 adapted for use in connection with tubing of a diameter of approximately ¼ to ½ inch includes three corrugating gears 24 mounted to a triangular bearing support 32. Each of the gears is provided with a different prime number of gear teeth, such as 11, 13 and 17 teeth, respectively. Those skilled in the art will recognize that, in order to maintain a constant pitch of the three gears, the gear diameters must be different. Accordingly, triangular support 26 is constructed to accommodate such a difference. The general construction of the head is as known in the art, with the axis of rotation for each of the gears 24 being transverse to the major axis or length of the cable 38, which in the figure is perpendicular to the plane of the sheet. As the cable is drawn through the corrugating head 30, the head rotates as depicted by the arrow, the gears 24 orbiting about the cable as the free wheel about their individual axes.

Because the bearing support of the corrugating head may be asymmetrical as a result of the incorporation of differently-shaped gear wheels, it is important that the head be carefully constructed and balanced, by use of borings, counterweights and the like, as known in the art, to insure that vibrations are minimized. The use of appropriate sensors, as known in the art, to monitor vibration as the corrugating apparatus is in operation is also encouraged, such that operation can be halted or adjusted if vibrations become excessive.

Figure 4:
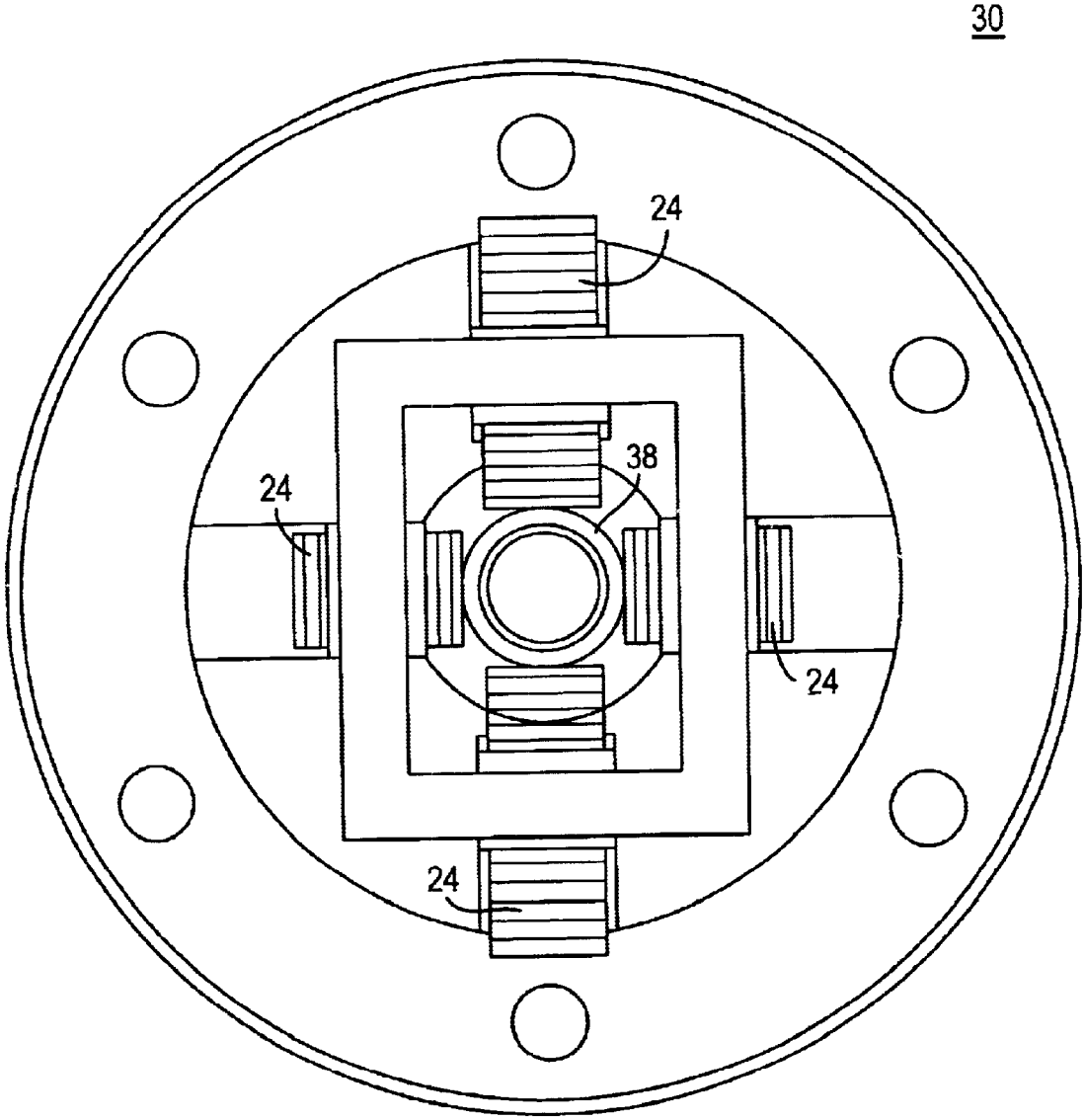
FIG. 4 is an end view of a corrugating head of the present invention utilizing four gears.

FIG. 4 depicts a corrugating head 30 in which four gears 24, mounted orthogonally to each other, is provided. Such a construction may be used in connection with cables and tubing of a diameter in the range of 0.50 to 0.866 inch. In such a case, the gears may have 11, 13, 17 and 19 teeth, respectively.

Figure 5:
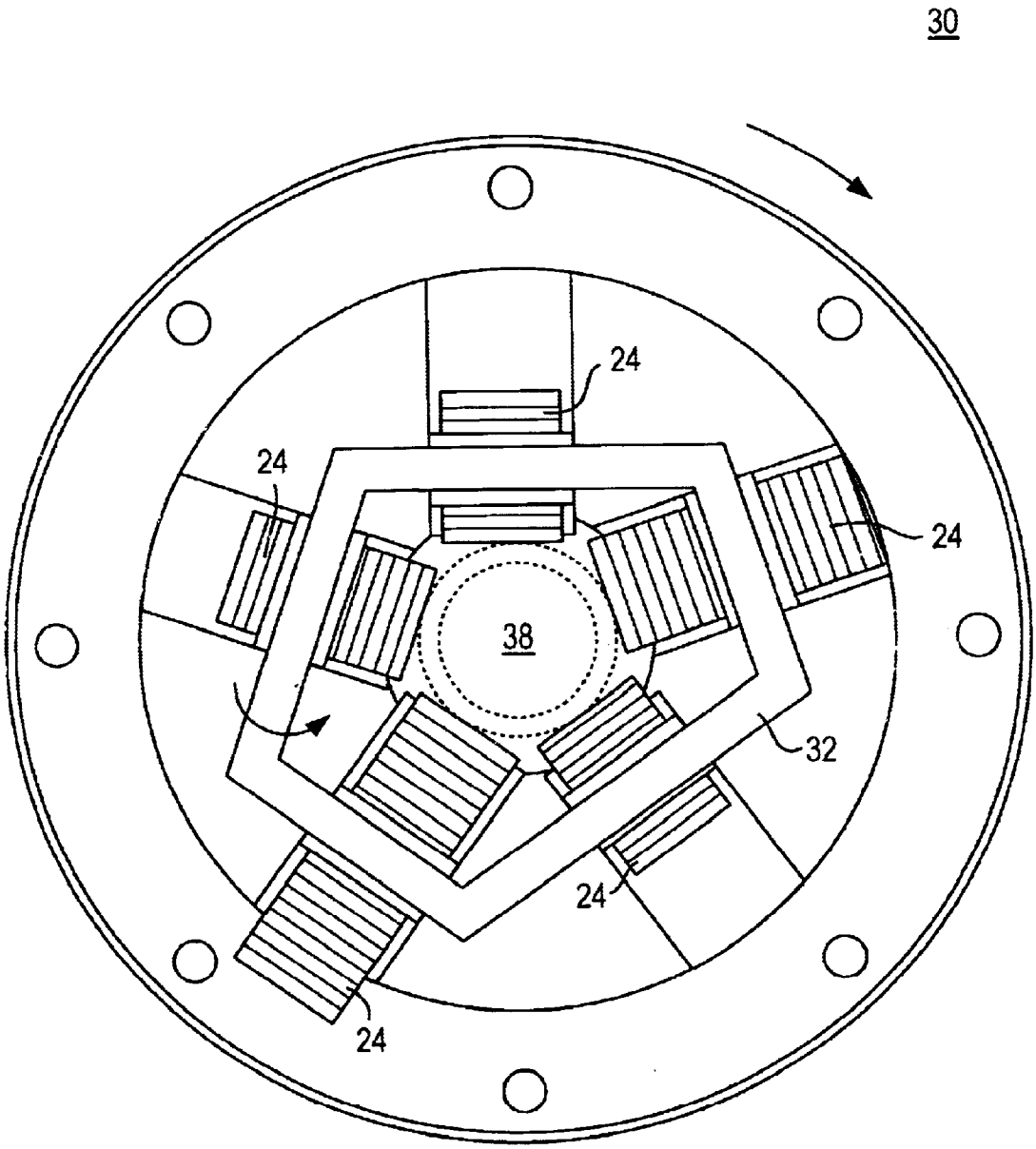
FIG. 5 is an end view of a corrugating head of the present invention utilizing five gears.

In a similar manner, FIG. 5 discloses a corrugating head 30 having five gears 24, each with a different prime number of teeth. The gears are mounted to pentagonal support 32, which is constructed and dimensioned as appropriate to accommodate the gears of different diameter. In such a case, the gears may have 11, 13, 17, 21 and 23 teeth, respectively.

Figure 6:
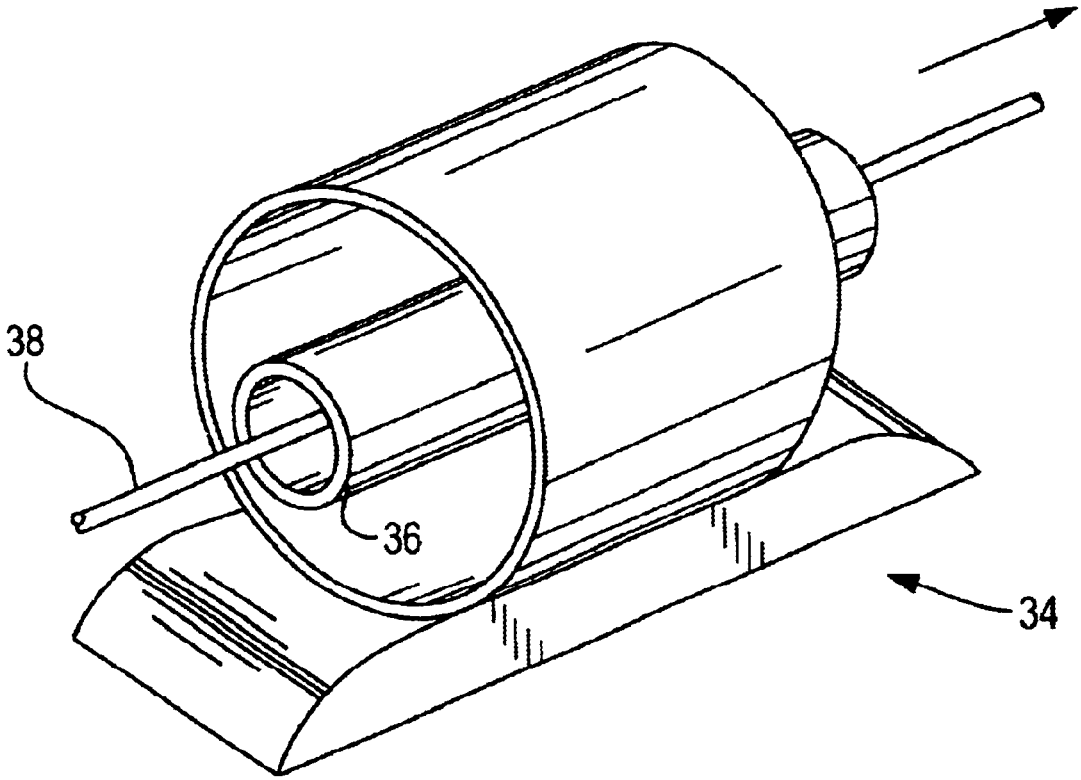
FIG. 6 is a perspective view of a hollow shaft motor which may be incorporated into the present invention.

The use of a corrugating head with gears each having a different prime number of gear teeth significantly decreases the constructive interference of the vibration patterns generated by the gears and associated fixturing, resulting in the forming of corrugated tubing and cable of significantly improved and consistent characteristics. In order to further decrease both the complexity of the corrugating head as well as the attendant vibration, a corrugating head in accordance with the present invention utilizing a plurality of primary number teeth gears may utilize a hollow shaft motor, is depicted in FIG. 6. As shown therein, hollow shaft motor 34 is an electrical motor of generally conventional construction but with a hollow armature shaft 36. The aperture extending through the shaft is of a diameter sufficient to mount and support the corrugating head therein. The cable or tubing 38 is fed through the shaft and corrugating head therein in accordance with known techniques. Such a construction can further decrease the vibration and other inconsistencies transferred from the gear head to the cable or tubing and further enhance the quality of the produced product.

Figure 7A:
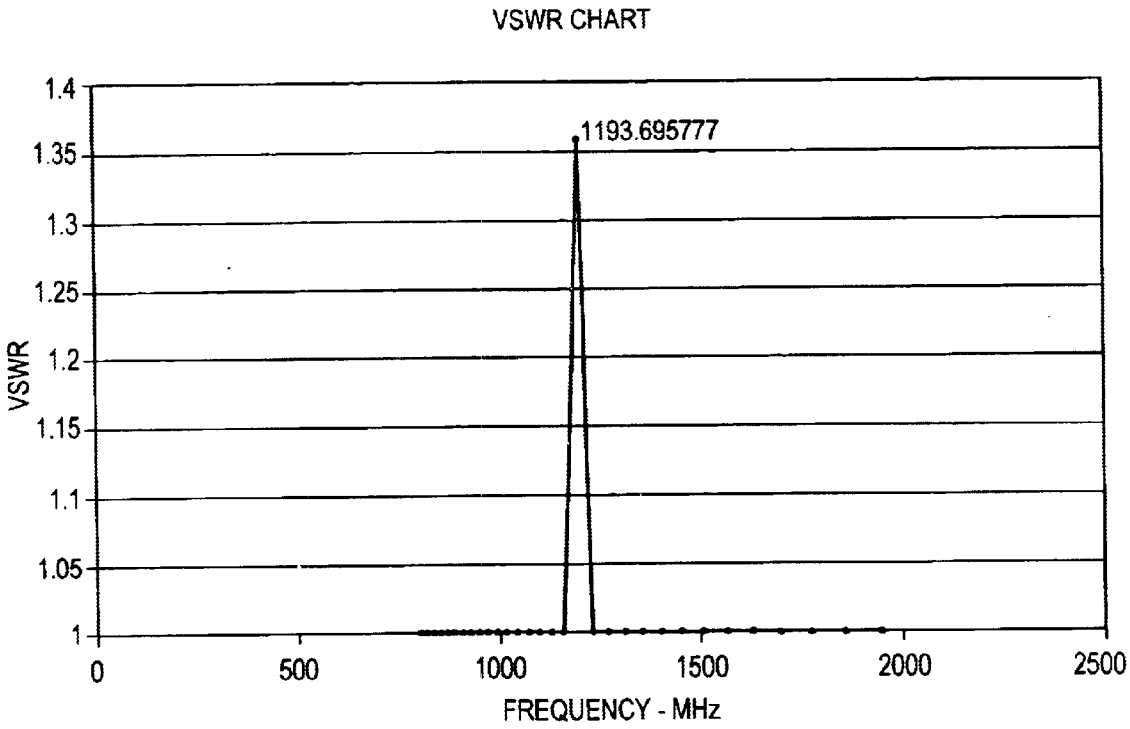
FIGS. 7*a–c* are a series of charts depicting the simulated VSWR response of conventional annular corrugated cables.
Figure 7B:
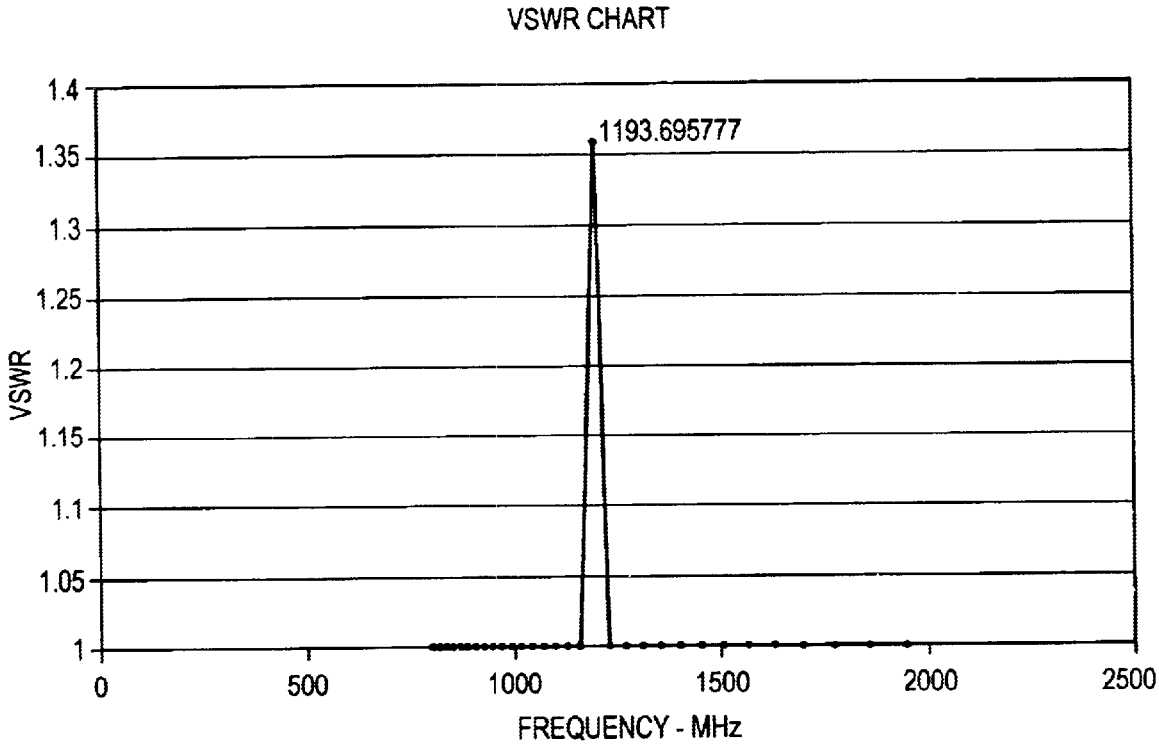
Figure 7C:
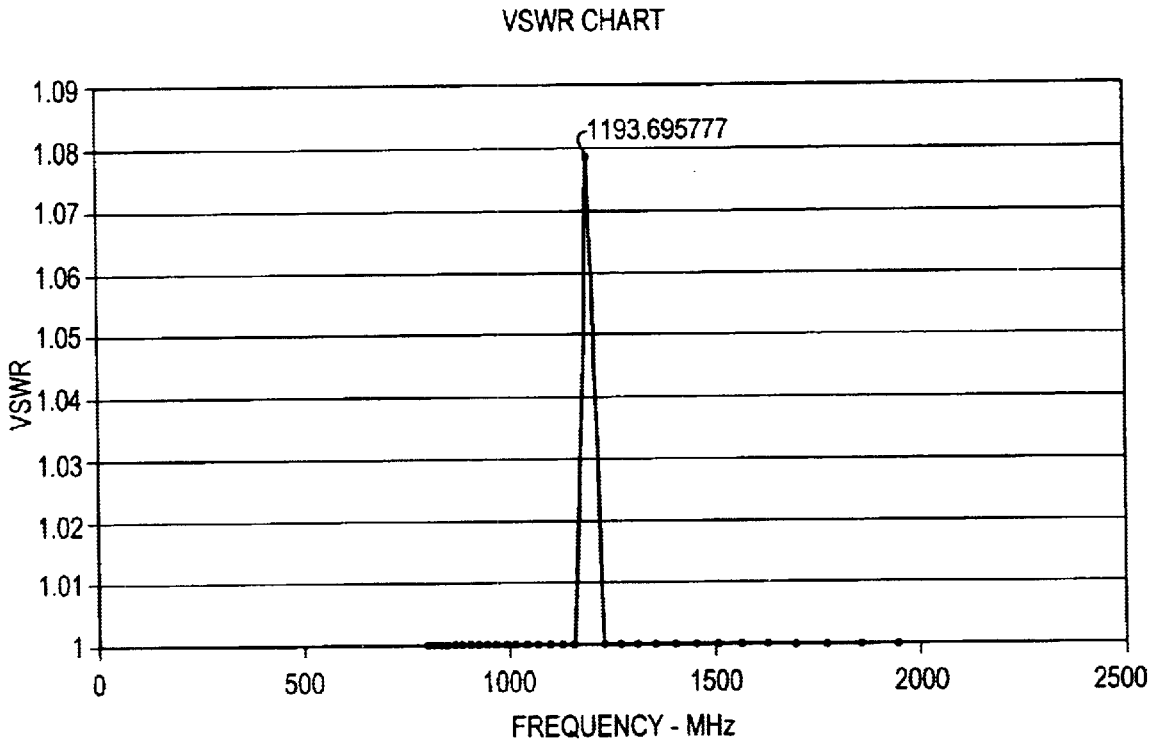
Figure 8A:
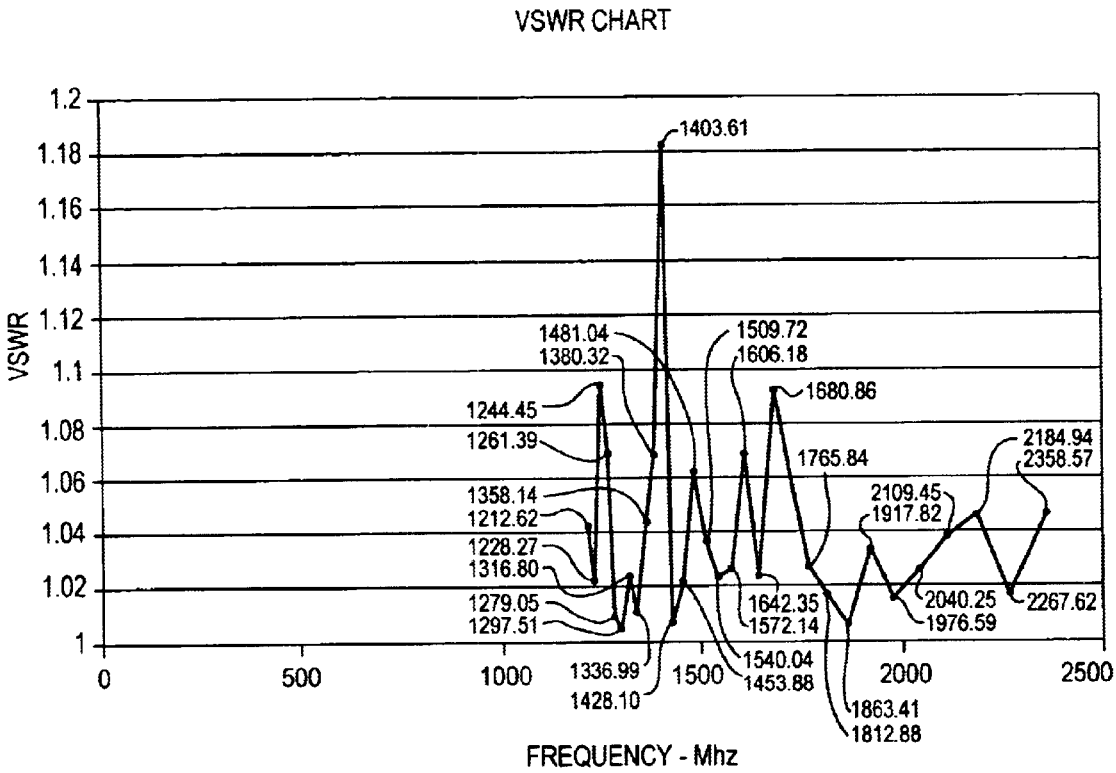
FIGS. 8*a–c* are a series of charts depicting the simulated response of corresponding annular corrugated cables as formed by the present invention.
Figure 8B:
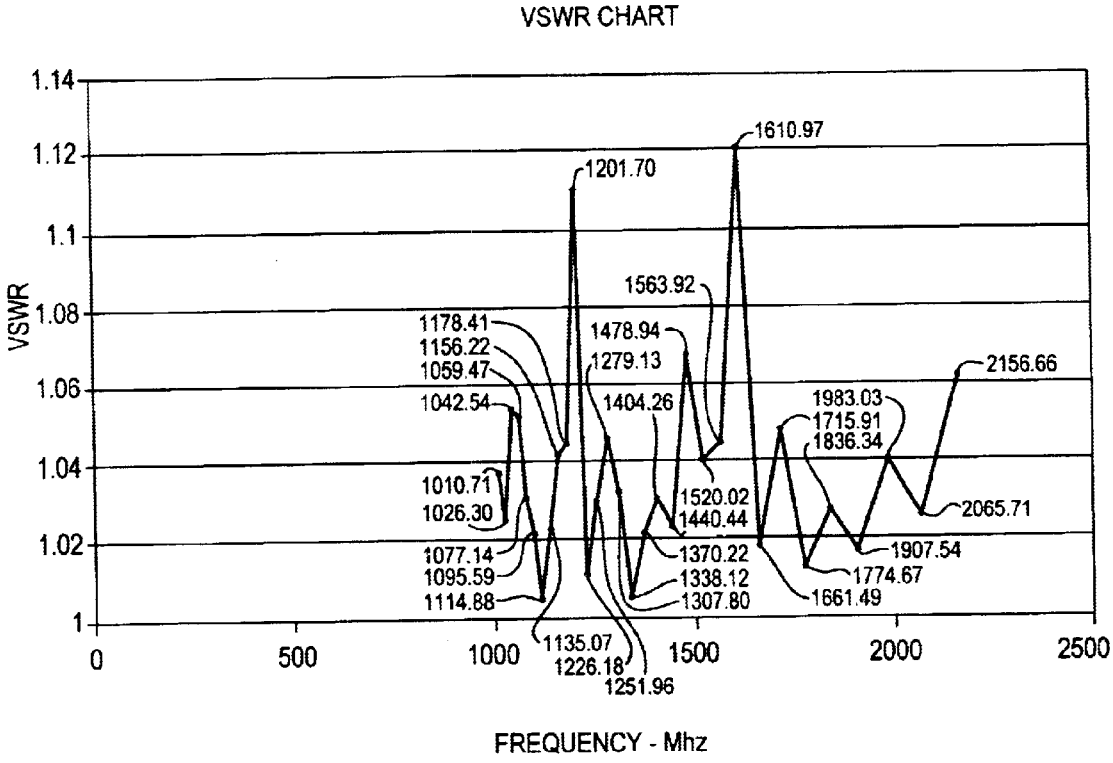
Figure 8C:
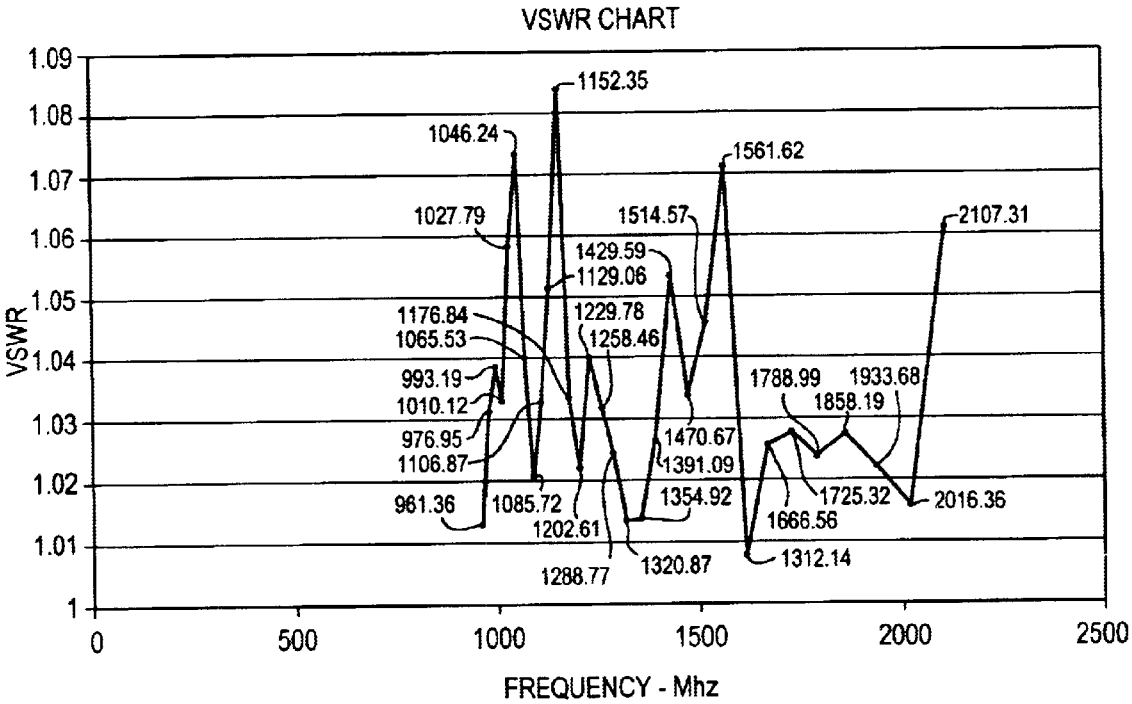

FIGS. 7*a–c* and 8*a–c* set forth calculated VSWR ratios for a frequency range of approximately 1000 to 2000 MHz for various diameter coaxial cables produced by corrugating heads having gears which have a constant number of gear teeth (FIGS. 7*a–c*) and with different prime numbers of gear teeth in accordance with the invention (FIGS. 8*a–c*). In each case, the charts for heads are the same number of teeth are placed adjacent to each other. FIGS. 7*a*, 8*a*, for example, both depict data for 3 gear heads. The simulations were performed by assigning a random impedance value to each gear tooth of each gear in the range of +/−2.00 ohm about the nominal impedance value for the cable simulated, typically 50 ohm. The impedence variation impressed upon the cable at any point is that of the gear tooth in contact with the cable at that point which is assigned the highest impedence. A Fast Fourier Transform is applied to the resulting simulated cable length and the corresponding VSWR values are generated. The values are representative of the effects of the gear teeth forming the corrugations, illustrate periodic faults continually repeated along a cable length, and do not take into account any other potential cable defects or irregularities. Actual VSWR values.

In general, cable quality equates to consistency of VSWR over the frequency spectrum of interest. The greater the variation or spreading of VSWR peaks as depicted in the simulations the less the likelihood that a single peak or spike will in the real world be of sufficient magnitude to be of concern. It can be seen that the significant single VSWR spike which exists in a cable produced by a corrugating gear having gears with the same number of teeth is in each case replaced by a plurality of spikes, typically of a significantly attenuated VSWR. Indeed, as a result of limitations in the simulation, in practice the actual magnitude of the single spike may be in a range from 2 to 3 times the magnitude shown, while the magnitudes of the multiple spike spectra are not so increased. While a conventionally-produced cable may be useful at frequencies except those closest to the frequency of the VSWR spike, the present invention allows a "universal" cable, capable of being operated at a wide frequency range, to be produced, with low VSWR at all frequencies.

It has been further found that the benefits of a gear head having differing prime numbers of teeth can also be achieved by a gear head having both differing prime number tooth gears and gears having non-prime or the same number of teeth, as the spreading of VSWR peaks can still be accomplished by such combinations. For gear heads of three gears, it has been found that at least two gears should be of differing prime number teeth. For gear heads of four or five gears, at least three of the gears should be of differing prime number teeth.

I claim:

1. An apparatus for the forming of corrugations in tubing, comprising a corrugating head having at least two corrugating gears each having a gear axis transverse to a major axis of the tubing and means for rotating the corrugating head with respect to the major axis of the tubing, each of the corrugating gears having the same pitch and a different, prime number of gear teeth.

2. The apparatus of claim 1 wherein the number of gears is in the range of two to six.

3. The apparatus of claim 1 or 2 wherein each prime number is in the range of 11 to 29.

4. The apparatus of claim 1 or 2 wherein the means for rotating the corrugating head is a hollow shaft motor.

5. The apparatus of claim 4 wherein the corrugating head is mounted with a hollow shaft of the hollow shaft motor.

6. A method for the forming of corrugations in tubing, comprising passing of a tube through a corrugating head having at least two corrugating gears each having a gear axis transverse to a major axis of the tubing, while the corrugating head is rotated with respect to the major axis of the tubing to emboss upon the tubing a series of annular corrugations formed by the gears of the gear head, each of the gears having the same pitch and a different, prime number of gear teeth.

7. An apparatus for the forming of corrugations in tubing, comprising a corrugating head having at least three corrugating gears each having a gear axis transverse to a major axis of the tubing and means for rotating the corrugating head with respect to the major axis of the tubing, at least two of the corrugating gears having the same pitch and a different, prime number of gear teeth.

8. The apparatus of claim 7 wherein at least half the number of gears have the same pitch and a different, prime number of gear teeth.

9. The apparatus of claim 8 wherein the number of gears is four or five and at least three of the gears have a different, prime number of gear teeth.

10. A method for the forming of corrugations in tubing, comprising passing of a tube through a corrugating head having at least two corrugating gears each having a gear axis transverse to a major axis of the tubing, while the corrugating head is rotated with respect to the major axis of the tubing to emboss upon the tubing a series of annular corrugations formed by the gears of the gear head, at least two of the gears having the same pitch and a different, prime number of gear teeth.

* * * * *